United States Patent [19]

Eiley et al.

[11] Patent Number: 4,984,721

[45] Date of Patent: Jan. 15, 1991

[54] GARMENT HANGER

[75] Inventors: Stan Eiley, Mount Royal; Marc Tremblay, Pierrefonds, both of Canada

[73] Assignee: E.R.A. Display Co. Ltd., Montreal, Canada

[21] Appl. No.: 404,203

[22] Filed: Sep. 7, 1989

[51] Int. Cl.[5] ..... A47G 25/48; A47G 25/44; A47G 25/14

[52] U.S. Cl. ..... 223/96; 223/95; 223/43; 223/91; 223/85

[58] Field of Search ..... 223/85, 88, 90, 91, 223/93, 96; 24/489, 499, 490, 567, 564

[56] References Cited

U.S. PATENT DOCUMENTS

| | | | |
|---|---|---|---|
| 972,439 | 10/1910 | Cutler | 223/91 |
| 2,473,408 | 6/1944 | Alkin | 223/96 |
| 2,496,331 | 2/1950 | Gray | 223/91 |
| 2,889,092 | 6/1959 | Gibron | 223/91 |
| 3,070,269 | 12/1962 | Zukerman | 223/88 |
| 3,268,128 | 8/1966 | Hobi | 223/96 |
| 3,357,126 | 12/1967 | Klieves | 43/43.12 |
| 4,034,903 | 7/1977 | Batts | 223/96 |
| 4,884,726 | 12/1989 | Kolton et al. | 223/91 |

*Primary Examiner*—Werner H. Schroeder
*Assistant Examiner*—Bibhu Mohanty
*Attorney, Agent, or Firm*—Samuel Meerkreebs

[57] ABSTRACT

A hanger having a hook and a linear beam with a flat web and a pair of spring clips on either end of the beam adapted for limited travel thereon, a first jaw of each clip is mounted for sliding movement on the beam and garment engaging ribs are provided on the inner face of the second jaw of the clip coacting with elongated ribs on the beam of the hanger for holding a garment therebetween, the clips are one-piece-molded plastics construction with a spring device urging the clips to close and the hanger is of one-piece-molded plastics construction.

3 Claims, 1 Drawing Sheet

Fig. 1
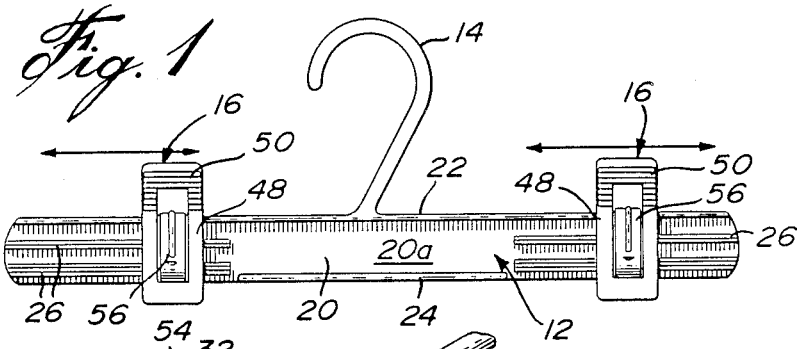
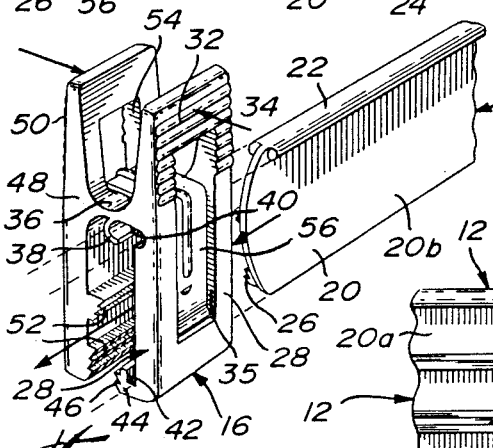
Fig. 2
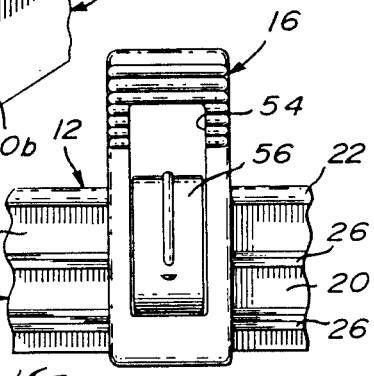
Fig. 3
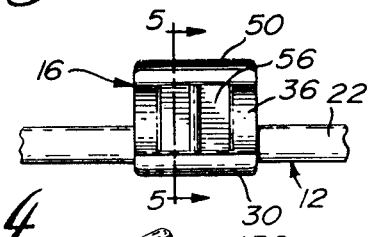
Fig. 4
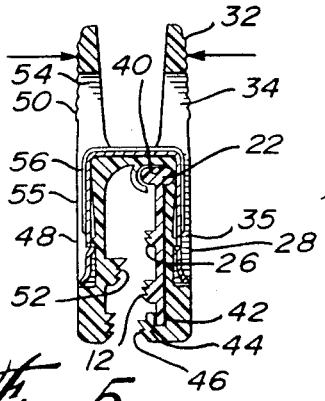
Fig. 5
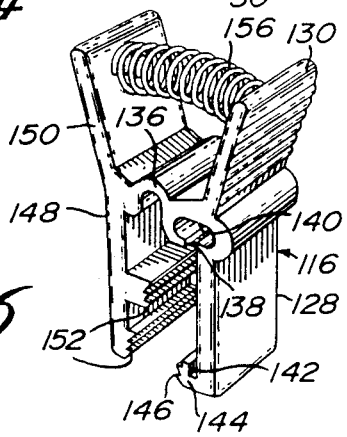
Fig. 6

GARMENT HANGER

BACKGROUND OF THE INVENTION

1. Field of the Invention

The present invention relates to hangers, and in particular, to garment hangers having a beam with clips thereon for engaging the garment.

2. Description of the Prior Art

It is well known from patents, such as U.S. Pat. No. 4,034,903, 1977, Batts, to provide a hanger having a beam on which clips are provided and are made to slide thereon to adjust to the size of the garment. Such prior art also describes the provision of the jaws of the clips being at the same level as the beam such that the beam is not exposed when the garment is on the hanger.

This type of hanger relies on a metal rod, as a beam, and conventional clips with jaws almost at the level of rod for gripping the garment. On the other hand, it has been the trend to provide molded plastics hangers in order to be more cost efficient. Furthermore it has been found that unless the jaws project below the beam that they do not exhibit good gripping characteristics.

SUMMARY OF THE INVENTION

It is an aim of the present invention to provide an improved hanger of molded plastics material.

It is another aim of the present invention to provide a hanger having a pair of traveling clips, each of which coact with the beam of the hanger for gripping a garment.

It is a further aim of the present invention to provide an improved clip.

A construction in accordance with the present invention comprises a hanger having a hook member and a linear beam having a generally planar web portion and enlarged track means at least at the upper edge thereof and a pair of clips mounted on the beam, one on each side of the hanger and each adapted to travel on the beam in a limited path extending from near the respective ends of the beam. Each clip includes a pair of jaws with a first jaw engaging the beam on a first face of the web and slidably engaging the track means on the beam, and the second jaw being resiliently mounted for pivotal movement to and from a second face of the web of the beam. Cooperating gripping means on the second jaw and the second face of the web are in the form of elongated ribs such that the second jaw can engage with the second face of the beam a garment therebetween at any position of the clip in the limited path of travel.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a front elevation of a hanger in accordance with the present invention;

FIG. 2 is a fragmentary prospective exploded view of a detail as shown in FIG. 1;

FIG. 3 is a fragmentary enlarged front elevation of a detail shown in FIG. 1;

FIG. 4 is a fragmentary top plan view of the detail shown in FIG. 3;

FIG. 5 as a vertical cross-section taken along the line 5—5 of FIG. 4;

FIG. 6 is a perspective view of another embodiment of a clip in accordance with the present invention.

DESCRIPTION OF THE PREFERRED EMBODIMENTS

Referring now to the drawings, there is shown in FIG. 1, a hanger 10 made up of a beam 12, a hock 14, and sliding clips 16. The hanger 10, including both the beam 12 and the hook 14, are molded in one piece from plastics material.

The beam 12 includes a flat web 20 having a front face **20*a* and a rear face 20*b*. A flange 22 extends the length of the beam on the top edge thereof and projects from both web surfaces 20*a* and 20*b* forming a T shaped cross-section. The flange 22 is best shown in FIG. 2. A short intermediate flange 24 is located along the bottom edge of the web 20 and extends only in the intermediate portion of the beam 12. Ribs extend axially of the beam 20 from the outer ends of the beam on the front face 20*a*, a distance from approximately the ends of the flange 24. Thus, as shown in FIG. 1, ribs 26** extend roughly one third the distance of the beam from the ends of each beam.

The clips 16 are identical and thus only one clip will be described. Clip 16 as shown in FIGS. 2 to 5 includes a first jaw 28 having a lever portion 30 and a rectangular opening 34 centrally of the lever 30, which in turn communicates with a recess 35 in the lower part of the jaw 28. Ribs 32 are provided in the lever portion 30 in order to enhance the handling thereof.

The clip 16 is a one-piece-molded item molded from plastics material. A bridge 36 extends between the first jaw 28 and the second jaw 48. A lip 38 extends downwardly from the bridge 36 and defines a flange receiving seat 40 with the body of the jaw 28. The contour defined by the flange receiving seat 40 matches the cross-section of the flange 22 on the beam 12. At the lower end of the jaw 28 there is provided a web receiving seat 42 defined by a flange 44 on which ribs 46 are provided.

The second jaw 48 includes a lever portion 50 with an opening 54 which communicates with a recess 55. Ribs 52 are provided on the inner face of the jaw 48 as shown. A spring 56 extends through the opening 34 and 54 and is seated in the recesses 35 and 55, as shown in FIG. 4. When the clip 16 is assembled on the beam 12 the flange 22 is seated within the flange receiving seat 40 as shown in FIG. 4 and the bottom of the web is seated within the web receiving seat 42. The clip 16 can be slid a limited distance on the beam, and that distance is limited by the flange 24 which prevents the clip from sliding any further towards the center of the beam. The first jaw 28 therefore extends mostly against the rear face **20*b* of the beam 12 with only the flange 44 being exposed at the bottom thereof. The ribs 52 which are spaced further up on the second jaw 48 coact with the ribs 26 on the web face. Thus, on urging of the spring 56 the jaws normally close against each other with the ribs 26 and 52 being interengaging. When the garment is held on the hanger 10 by the clips 16, opposed ribs 52 and 26 engage on either side to hold the garment within the clip 16 and the beam 12**.

Thus, there is provided a hanger with traveling clips 16 which can properly hold the garment at the level of the beam in order to hide the beam.

In another embodiment as shown in FIG. 6, the clip, in which the numerals have been raised by 100, is in this case, identified by numeral 116, having a first jaw 128 with a lever 130, and a bridge 136 merging with the second jaw 148. The second jaw 148 has a lever 150 and a spring 156 which in this case is a coil compression spring which extends between the levers 130 and 150. A lip 138 extends below the bridge 136, which in this case is reinforced. The lip 138 forms, with the first jaw 128, a flange receiving seat 140. The other elements in the clip 116.

We claim:

1. A garment hanger comprising a hook member and a linear beam, the beam having a generally planar web portion with first and second faces and T shaped track means at the upper edge thereof and at least a pair of clips mounted on the beam, one on each side of the hook member and each adapted to travel on the beam in a limited path extending from the respective ends of the beam, each clip of the pair of clips being separate one-piece molded clips of plastics material and each having a first and second jaw joined by a bridge and a separate spring member associated with the first and second jaw to urge the bottom portion of the second jaw towards the second face of the beam about a hinge axis through the bridge, said first jaw and said bridge defining track following seat means to slidably engage the T shaped track means on the beam and the first jaw is also provided with a hook-shaped flange at the bottom end to slidably engage the bottom edge of the beam and cooperating gripping means on the second jaw and the second face of the web in the form of elongated ribs such that the second jaw can engage, with the second face of the beam, and hold the garment therebetween at any position of the clip in the limited path of travel thereof.

2. A hanger as defined in claim 1, wherein the spring member is a U shape spring extending over the bridge through openings in the respective first and second jaws and against the outer surfaces of the bottom portions of the jaws, urging the jaws towards each other.

3. A hanger as defined in claim 1, wherein the spring is in the form of a coil spring extending between levers of each jaw above the bridge in order to urge the bottom portions of the jaws towards each other.

* * * * *